US010947727B1

(12) United States Patent
Rushing

(10) Patent No.: US 10,947,727 B1
(45) Date of Patent: Mar. 16, 2021

(54) PREFABRICATED POLE BARN

(71) Applicant: Ronald Rushing, Brookhaven, MS (US)

(72) Inventor: Ronald Rushing, Brookhaven, MS (US)

( * ) Notice: Subject to any disclaimer, the term of this patent is extended or adjusted under 35 U.S.C. 154(b) by 0 days.

(21) Appl. No.: 16/688,389

(22) Filed: Nov. 19, 2019

(51) Int. Cl.
*E04C 3/11* (2006.01)
*E04C 3/08* (2006.01)
*E04C 3/04* (2006.01)

(52) U.S. Cl.
CPC ..... *E04C 3/11* (2013.01); *E04C 3/08* (2013.01); *E04C 2003/0465* (2013.01); *E04C 2003/0491* (2013.01)

(58) Field of Classification Search
CPC ..... E04H 1/12; E04H 1/1205; E04H 6/025; E04H 15/36; E04B 1/32; E04B 2001/2493; E04B 2001/2487; E04C 3/11
See application file for complete search history.

(56) References Cited

U.S. PATENT DOCUMENTS 2,764,107 A * 9/1956 Niswonger ..... E04C 3/11 52/643
4,253,210 A * 3/1981 Racicot ..... E04C 3/08 14/13
4,970,833 A * 11/1990 Porter ..... E04B 1/24 403/171
6,003,280 A * 12/1999 Wells ..... E04B 1/08 52/653.1
6,438,920 B1 * 8/2002 Tobey ..... E04B 7/022 52/639
7,325,362 B1 * 2/2008 Rowland ..... E04B 7/024 52/634
7,513,085 B2 * 4/2009 Moody ..... E04B 9/00 52/635
2002/0059774 A1 * 5/2002 Collins ..... E04C 3/07 52/690
2003/0230039 A1 * 12/2003 Rizzotto ..... E04B 1/34352 52/295
2008/0178555 A1 * 7/2008 Green ..... E04C 3/17 52/690
2012/0011797 A1 * 1/2012 Green ..... E04B 7/026 52/636
2016/0289989 A1 * 10/2016 Creagh ..... E04H 6/025

* cited by examiner

*Primary Examiner* — Christine T Cajilig
(74) *Attorney, Agent, or Firm* — Sanchelima & Associates, P.A.; Christian Sanchelima; Jesus Sanchelima

(57) ABSTRACT

A prefabricated pole barn including a truss assembly, a foundation assembly and a roof assembly is disclosed. The truss assembly includes specially made trusses made with galvanized square tubing or red iron tubing. The tubing helps to provide the trusses with added strength and stability. The design of the trusses along with a quickset foundation of the foundation assembly, particularly treated floor support poles of the foundation assembly, and a roof of the roof assembly help to provide with a quickly and easily assembled pole barn. The pole barn is further stronger, more stable and loadbearing in comparison to traditional pole barns using standard bar joist trusses made of wood.

18 Claims, 3 Drawing Sheets

PREFABRICATED POLE BARN

BACKGROUND OF THE INVENTION

1. Field of the Invention

The present invention relates to prefabricated pole barn and, more particularly, to a prefabricated pole barn that can be easily and quickly assembled anywhere.

2. Description of the Related Art

Several designs for prefabricated pole barns have been designed in the past. None of them, however, include the combination of the design of trusses and the use of galvanized square tubing and red iron tubing with quickset foundation and treated wood poles for assembling a pole barn.

Applicant believes that a related reference corresponds to U.S. Pat. No. 4,253,210 for a metal truss structure. Applicant believes another related reference corresponds to 2002/0059774 for a light gauge metal truss system and method. None of these references, however, teach of combing the design of trusses with galvanized square tubing or red iron tubing instead of with typical wood. Further, none of these references teach of a quickset foundation and treated wood poles as well as the specially designed trusses of the present invention for quickly and easily assembling a pole barn.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a prefabricated pole barn that includes specially designed trusses made of galvanized square tubing or red iron tubing instead of wood.

It is another object of this invention to provide a prefabricated pole barn that is quickly and easily assembled.

It is still another object of the present invention to provide a prefabricated pole barn that is stronger, steadier and loadbearing compared to standard pole barn constructions using standard bar joist trusses using wood.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
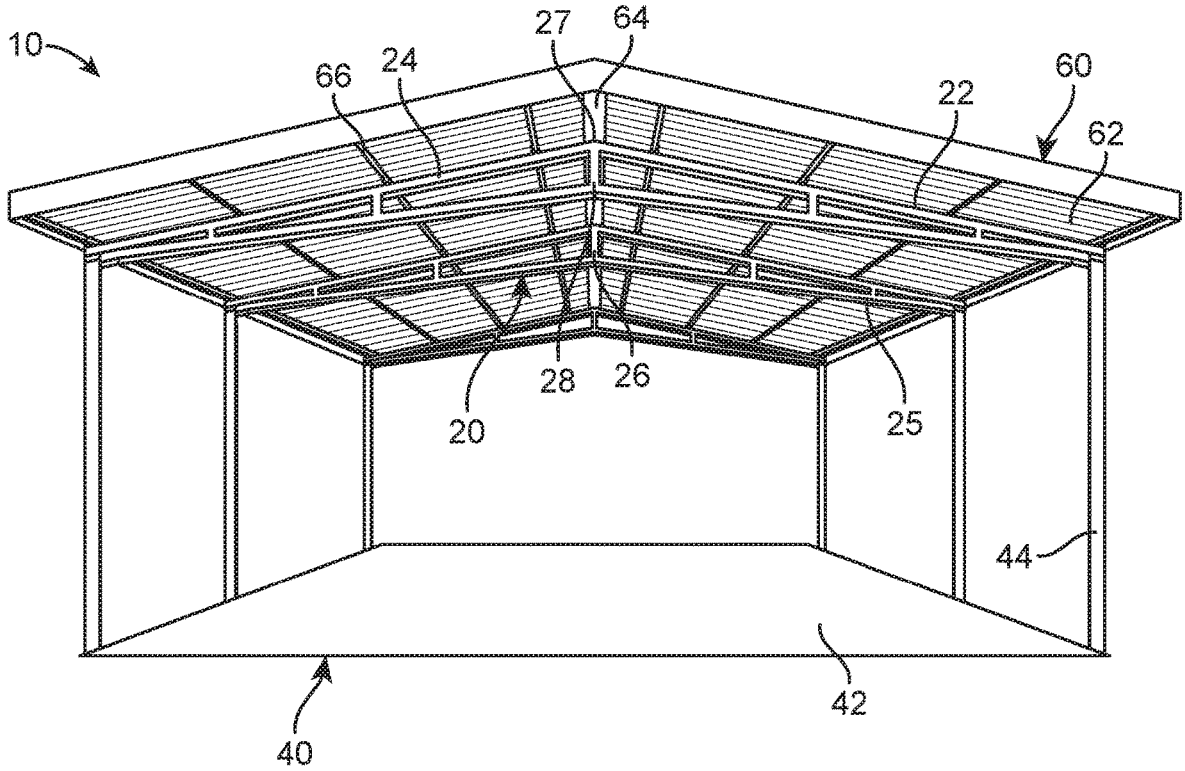
FIG. 1 represents an isometric view of the prefabricated pole barn fully assembled.

Referring now to the drawings, where the present invention is generally referred to with numeral 10, it can be observed that it, a prefabricated pole barn 10, basically includes a truss assembly 20, a foundation assembly 40 and a roof assembly 60.

Figure 2:
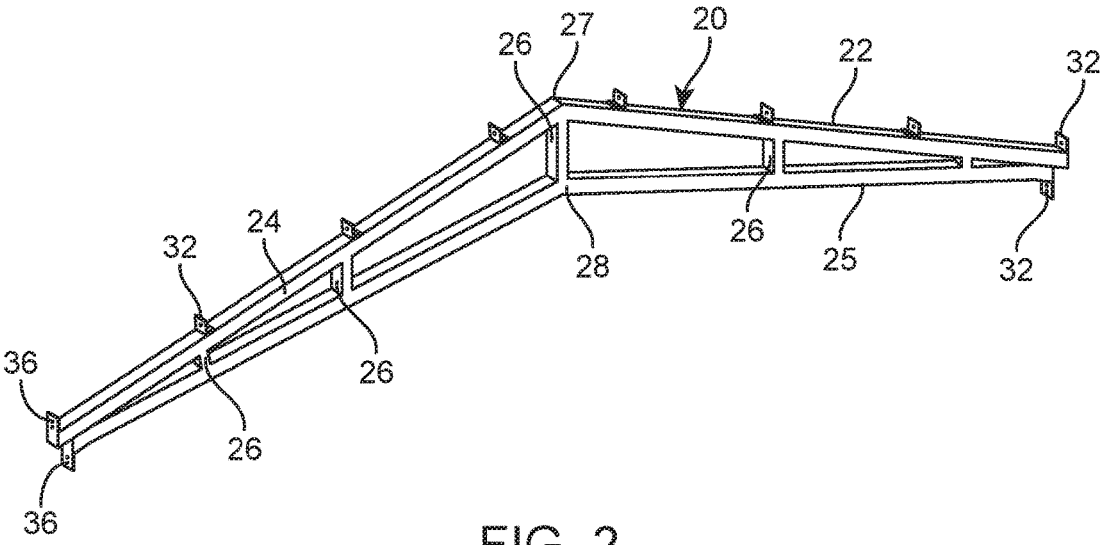
FIG. 2 illustrates an isometric view of the truss assembly.
Figure 3:
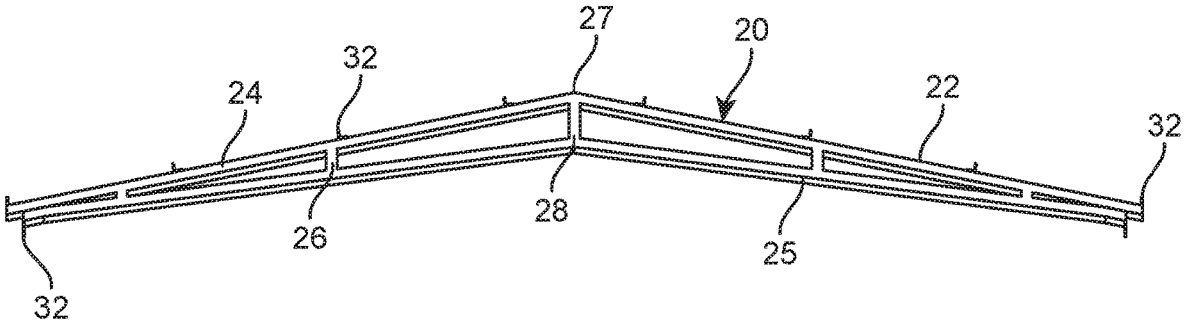
FIG. 3 shows a front view of the truss assembly to better show components not easily identifiable in the isometric view.
Figure 4:
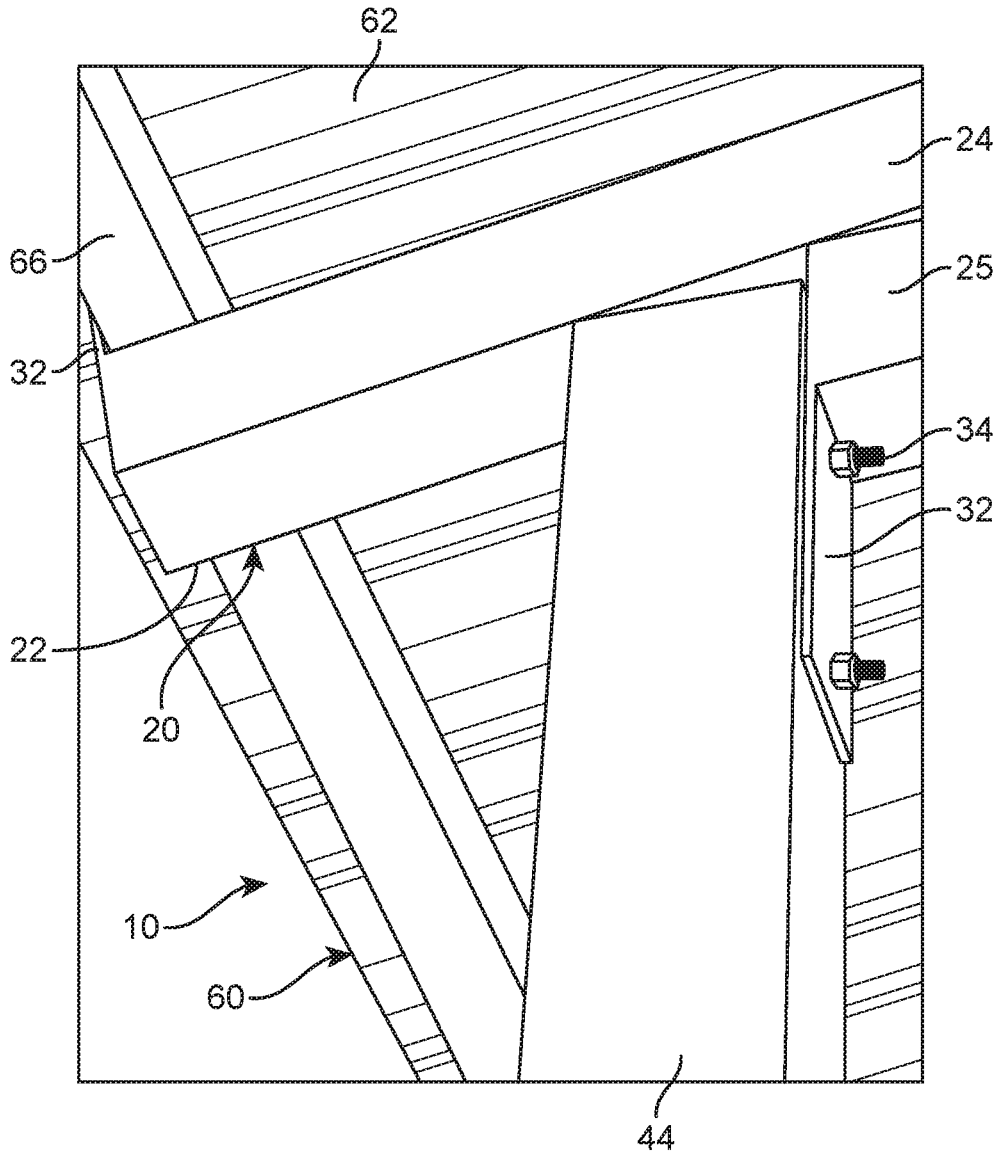
FIG. 4 is a representation of a zoomed in view of the truss assembly being mounted and secured to the roof assembly.

Referring to FIG. 1-4, it can be seen that the present invention, prefabricated pole barn 10 is depicted. Importantly, it can be seen that truss assembly 20 provides the backbone of prefabricated pole barn 10. Truss assembly 20 includes a plurality of trusses 22. Each of trusses 22 may be of predetermined dimensions as per the needs of a user. The dimensions of trusses 22 depends on the needed size of prefabricated pole barn 10. In the case that the needed trusses 22 are too large then they may be assembled of multiple smaller pieces. However, if suitable trusses 22 may be made entirely whole and integral. It should be understood, however, that the structure and shape of trusses 22 may not change regardless of dimensions and size. Preferably, each of trusses 22 is made with square tubing for stability and strength. Trusses 22 may further be made of galvanized square tubing or red iron tubing. In an alternate embodiment, it may be suitable for trusses 22 to be coated with a galvanized coating or a red oxide coating. Trusses 22 may preferably have a slanted roof shape. Plurality of trusses 22 may include a long tubing 24, a short tubing 25 and support tubing 26. Long tubing 24 may be substantially more slanted than short tubing 25. Long tubing 24 and short tubing 25 may be adjacently mounted to one another. Long tubing 24 may preferably be mounted directly above short tubing 25. Long tubing 24 and short tubing 25 may be separated by support tubing 26. Support tubing 26 may vertically extend therebetween long tubing 24 and short tubing 25. Long tubing 24 and short tubing 25 may make contact only at distal ends thereof. Long tubing 24 on the left side may make contact with long tubing 24 on the right side to create a first peak 27 at the meeting point thereof. Likewise, short tubing 25 on the left side may make contact with short tubing 25 on the right side to create a second peak 28 at the meeting point thereof. It should be understood that if trusses 22 are made integral then first peak 27 may be at a midpoint of long tubing 24 and second peak 28 may be at a midpoint of short tubing 25. One of support tubing 26 extends therebetween first peak 27 and second peak 28. Support tubing 26 may otherwise be mounted at predetermined locations between long tubing 24 and short tubing 25. Support tubing 26 may become successively shorter as the distal ends of long tubing 24 and long tubing 25 are reached. When trusses 22 are of longer predetermined dimensions more of support tubing 26 may be necessary. When trusses 22 are of shorter predetermined dimensions less of support tubing 26 may be necessary. On a top surface of each of long tubing 24 may be upwardly extending mounting brackets 32 mounted thereon. On the distal end of each of short tubing 25 may be one downwardly extending of mounting brackets 32. Mounting brackets 32 mounted thereon long tubing 24 aid in securing long tubing 24 to roof assembly 60 with fasteners 34. While mounting brackets 32 mounted thereon on short tubing 25 aid in securing short tubing 25 to foundation assembly 40 with fasteners 34. Fasteners 34 may be mounted perpendicularly therethrough mounting brackets 32 through fastener opening 36. It may be suitable for mounting brackets to include more than one of fastener opening 36 when required. With the exception of fasteners 34, all other components and elements of truss assembly may be made of a galvanized or red iron material or of a material with a red oxide or galvanized coating, preferably. Trusses 22 of the present invention may be more durable, strong and stable than traditional trusses made of wood.

Prefabricated pole barn 10 may further include foundation assembly 40 below truss assembly 20. Foundation assembly 40 may include a ground surface 42. Ground surface 42 may be a floor. Ground surface 42 may preferably be a quickset foundation. To achieve the quickset characteristic of ground surface 42 quickset concrete may be used to make ground surface 42. It may be suitable for ground surface 42 to be made of other materials. Preferably, ground surface 42 may be flat. It should also be understood that ground surface 42 may be of a predetermined shape and dimensions. Extending therefrom ground surface 42 may be ground supported poles 44. Ground supported poles 44 may preferably be of a predetermined shape and dimensions. It may also be suitable for ground supported poles 44 to be mounted at predetermined locations thereon ground surface 42. Ground supported poles 44 may extend until truss assembly 20 is reached. It should be understood that the number of ground supported poles 44 may be any predetermined amount. The number of ground supported poles 44 may depend on the dimensions and shape of the present invention. In one embodiment, ground supported poles 44 may preferably be treated wood poles. It should be understood that other materials besides wood may be suitable for ground supported poles 44 such as metal, aluminum, steel, plastic or the like. Ground supported poles 44 may mounted thereto ground surface 42 for added safety, security and stability with fasteners 34.

Prefabricated pole barn 10 may further include roof assembly 60. Roof assembly 60 includes roof 62 of a predetermined shape and dimensions. In one embodiment, roof 62 may be rectangular. Roof 62 may be mounted thereon truss assembly 20. It may be suitable for roof 62 to extend entirely over trusses 22. Roof 62 may provide shade to the area entirely underneath thereof. Roof 62 may include structural support to ensure that roof 62 is stable and strong. Extending entirely underneath a length of roof 62 may be a middle support beam 64 centrally located. Additionally, also extending entirely underneath the length of roof 62 may be roof support beams 66. Roof support beams 66 may all be parallel to one another. Middle support beam 64 may also be parallel to roof support beams 66. Middle support beam 64 and roof support beams 66 may be mounted perpendicularly to trusses 22. Middle support beam 64 and roof support beams 66 may be mounted and secured to trusses 22 with mounting brackets thereon trusses 22 and fasteners 34. Roof support beams 66 may extend towards the lateral sides of roof 62. It may be suitable for roof 62, middle support beam 64 and roof support beams 66 to be made of aluminum preferably. However, it may also be suitable for roof 62, middle support beam 64 and roof support beams 66 to be made of steel, metal, plastic, rubber, ceramic or the like as known in the art.

It should be understood that the present invention may be quickly and easily assembled or disassembled. It can be seen that the present invention can help to provide shade or shelter to an area located entirely underneath truss assembly 20. It should be understood that the present invention may be made of predetermined shape and dimensions as per the needs of the user. Prefabricated pole barn 10 may be made large or small and the structure remains the same. The difference between small and large prefabricated pole barn 10 is simply more usage of same elements. The present invention is also stronger, more stable and safer than traditional pole barns due to the square tubing structure as well as the use of galvanized tubing and red iron tubing.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a prefabricated pole barn, comprising:

a. a truss assembly including a plurality of trusses, each of said plurality of trusses includes long tubing which extends upwardly on a left side of said plurality of trusses and downwardly on a right side of said plurality of trusses, said long tubing creating a first peak at a midpoint of said long tubing, each of said plurality of trusses also includes short tubing extending upwardly on the left side of said plurality of trusses and downwardly on the right side of said plurality of trusses, said short tubing creating a second peak at a midpoint of said short tubing, said long tubing being supported above said short tubing by support tubing which extends vertically between said short tubing and said long tubing at predetermined locations, said support tubing being parallel to each other, said support tubing being of different heights between said short tubing and said long tubing, said support tubing getting shorter towards lateral ends of said plurality of trusses, said plurality of trusses having mounting brackets secured thereto, said mounting brackets mounted on said long tubing and extending upwardly at predetermined locations from said long tubing, said mounting brackets also mounted on said short tubing at distal ends thereof, said mounting brackets on said short tubing being in constant abutting contact with said distal ends, said mounting brackets secured to said short tubing extending downwardly therefrom, said mounting brackets secured to said short tubing being entirely below said short tubing, each of said mounting brackets including fastener opening therethrough;

b. a foundation assembly including a ground surface and ground support poles, said ground support poles extending from said ground surface and being mounted to said plurality of trusses, said ground support poles secured to said mounting brackets on said short tubing and secured with fasteners extending through said fastener opening; and c. a roof assembly including a roof mounted to said plurality of trusses, said roof having a middle support beam extending at a length of said roof at a midpoint thereof, said roof including roof support beams extending along a length of said roof towards lateral sides of said roof, said roof mounted to said mounting brackets along said long tubing and secured with said fasteners.

2. The system of claim 1, wherein said support tubing between said first peak and said second peak being the longest.

3. The system of claim 1, wherein said support tubing between said long tubing and said short tubing being shorter towards lateral ends thereof.

4. The system of claim 1, wherein said plurality of trusses are made of a galvanized square tubing and red iron tubing.

5. The system of claim 1, wherein said plurality of trusses are coated with a galvanized tubing and a red iron tubing.

6. The system of claim 1, wherein said ground surface is a quickset foundation.

7. The system of claim 1, wherein said ground supported poles are treated wood poles.

8. The system of claim 1, wherein said mounting brackets are perpendicular to said plurality of trusses.

9. The system of claim 1, wherein said roof slopes downwards on a left side and right side.

10. The system of claim 1, wherein said middle support beam is thicker than said roof support beams.

11. The system of claim 1, wherein said roof support beams are parallel to each other on a left side and a right side of said roof.

12. A system for a prefabricated pole barn, consisting of:

a. a truss assembly including a plurality of trusses, each of said plurality of trusses includes long tubing located on a top portion of said plurality of trusses, each of said plurality of trusses also includes short tubing located on a bottom portion of said plurality of trusses, said long tubing being supported above said short tubing by support tubing which extends vertically between said short tubing and said long tubing at predetermined locations, said support tubing being parallel and of varying heights, said plurality of trusses having mounting brackets secured thereto, said mounting brackets mounted on long tubing distal ends said long tubing and extending upwardly from long tubing distal ends, said mounting brackets being in constant abutting contact with said long tubing distal ends, said mounting brackets also mounted on said short tubing at short tubing distal ends, said mounting brackets on said short tubing being in constant abutting contact with said short tubing distal ends, said mounting brackets secured to said short tubing extending downwardly therefrom, said mounting brackets secured to said short tubing being entirely below said short tubing, each of said mounting brackets including fastener opening therethrough, said plurality of trusses being made of square tubing;

b. a foundation assembly including a ground surface and ground support poles, said ground support poles extending from said ground surface and being mounted to said plurality of trusses, said mounting brackets engaging only an inner side of said ground support poles; and c. a roof assembly including a roof mounted to said plurality of trusses, said roof having a middle support beam extending at a length of said roof at a midpoint thereof, said roof including roof support beams extending along a length of said roof towards lateral sides of said roof.

13. The system of claim 1, wherein said mounting brackets secured to said short tubing being entirely below mounting brackets secured to said long tubing.

14. The system of claim 1, wherein said mounting brackets are secured to ends of said long tubing in constant abutting contact therewith.

15. The system of claim 14, wherein said mounting brackets secured to the ends of long tubing being on a vertical plane parallel to a vertical plane of the mounting brackets secured to the distal ends of said short tubing.

16. The system of claim 1, wherein said mounting brackets of said short tubing engage said ground support poles only on an inner side of said support poles.

17. The system of claim 12, wherein said square tubing is galvanized.

18. The system of claim 12, said plurality of trusses are made of red iron tubing.

* * * * *